US007311385B2

(12) United States Patent
Edelen et al.

(10) Patent No.: US 7,311,385 B2
(45) Date of Patent: Dec. 25, 2007

(54) MICRO-FLUID EJECTING DEVICE HAVING EMBEDDED MEMORY DEVICE

(75) Inventors: John G. Edelen, Versailles, KY (US); George K. Parish, Winchester, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 378 days.

(21) Appl. No.: 10/706,457

(22) Filed: Nov. 12, 2003

(65) Prior Publication Data

US 2005/0099458 A1 May 12, 2005

(51) Int. Cl.
*B41J 2/05* (2006.01)

(52) U.S. Cl. ..... 347/57; 347/58; 347/50

(58) Field of Classification Search ..... 347/59, 347/57, 50, 58; 365/163, 185.15
See application file for complete search history.

(56) References Cited

U.S. PATENT DOCUMENTS

| | | | | |
|---|---|---|---|---|
| 3,500,142 | A | 3/1970 | Kahng | 365/185.01 |
| 3,660,819 | A | 5/1972 | Frohman-Bentchkowsky | 317/235 |
| 4,203,158 | A | 5/1980 | Frohman-Bentchkowsky et al. | 365/188 |
| 4,758,984 | A | 7/1988 | Yoshida | 365/53 |
| 4,876,668 | A * | 10/1989 | Thakoor et al. | 365/163 |
| 4,970,565 | A | 11/1990 | Wu et al. | 357/23.5 |
| 5,029,130 | A | 7/1991 | Yeh | 365/185 |
| 5,068,697 | A | 11/1991 | Noda et al. | 357/23.5 |
| 5,440,510 | A | 8/1995 | Caprara et al. | 365/185 |
| 5,519,246 | A | 5/1996 | Shirota et al. | 257/435 |
| 5,544,103 | A * | 8/1996 | Lambertson | 365/185.15 |
| 5,835,115 | A | 11/1998 | Kitazawa | 347/57 |
| 5,851,075 | A | 12/1998 | Imai | 400/120.14 |
| 5,943,268 | A | 8/1999 | Nguyen | 365/185.29 |
| 6,190,948 | B1 | 2/2001 | Seok | 438/140 |
| 6,439,697 | B1 * | 8/2002 | Axtell et al. | 347/57 |
| 6,460,966 | B1 | 10/2002 | Hellekson et al. | 347/20 |
| 6,474,782 | B1 * | 11/2002 | Furukawa | 347/50 |
| 6,512,284 | B2 | 1/2003 | Schulte et al. | 257/530 |
| 6,582,043 | B2 | 6/2003 | Ishizaki | 347/12 |
| 2002/0126301 | A1 | 9/2002 | Bowers | 358/1.9 |
| 2003/0002899 | A1 | 1/2003 | Furukawa et al. | 400/120.01 |

FOREIGN PATENT DOCUMENTS

| | | |
|---|---|---|
| JP | 57176771 | 10/1982 |

(Continued)

OTHER PUBLICATIONS

Millman, Jacob, "Microelectronics: Digital and Analog Circuits and Systems," McGraw-Hill, Inc., p. 280-281, (1979).

*Primary Examiner*—Lam Son Nguyen
(74) *Attorney, Agent, or Firm*—Luedeka Neely & Graham

(57) ABSTRACT

A semiconductor substrate for a micro-fluid ejecting device. The semiconductor substrate includes a plurality of fluid ejection devices disposed on the substrate. A plurality of driver transistors are disposed on the substrate for driving the plurality of fluid ejection devices. A programmable memory matrix containing embedded programmable memory devices is operatively connected to the micro-fluid ejecting device for collecting and storing information on the semiconductor substrate for operation of the micro-fluid ejecting device. The programmable memory matrix provides a high density of memory bits embedded on the substrate for storing information about the micro-fluid ejecting device.

20 Claims, 8 Drawing Sheets

FOREIGN PATENT DOCUMENTS

| | | |
|---|---|---|
| JP | 58197777 | 11/1983 |
| JP | 59006581 | 1/1984 |
| JP | 1224997 | 9/1989 |
| JP | 7202040 | 8/1995 |
| JP | 10189774 | 7/1998 |

* cited by examiner

MICRO-FLUID EJECTING DEVICE HAVING EMBEDDED MEMORY DEVICE

FIELD OF THE INVENTION

The invention relates to ink jet printheads and in particular to ink jet printheads containing memory devices embedded in a printhead substrate.

BACKGROUND OF THE INVENTION

Ink jet printers continue to experience wide acceptance as economical replacements for laser printers. Such ink jet printers are typically more versatile than laser printers for some applications. As the capabilities of ink jet printers are increased to provide higher quality images at increased printing rates, printheads, which are the primary printing components of ink jet printers, continue to evolve and become more complex. As the complexity of the printheads increases, so does the cost for producing the printheads. Nevertheless, there continues to be a need for printers having enhanced capabilities. For example, ink cartridges having memory attached to the cartridges enables printers to access data about the ink cartridge and tailor printing activities corresponding to the characteristics of the ink cartridges. Competitive pressure on print quality and price promote a continued need to produce printheads with enhanced capabilities in a more economical manner.

SUMMARY OF THE INVENTION

With regard to the foregoing and other objects and advantages there is provided a semiconductor substrate for a micro-fluid ejecting device. The semiconductor substrate includes a plurality of fluid ejection devices disposed on the substrate. A plurality of driver transistors are disposed on the substrate for driving the plurality of fluid ejection devices. A programmable memory matrix containing embedded programmable memory devices is operatively connected to the micro-fluid ejecting device for collecting and storing information on the semiconductor substrate for operation of the micro-fluid ejecting device.

In another embodiment there is provided an ink jet printer cartridge for an ink jet printer. The cartridges includes a cartridge body having an ink supply source and a printhead attached to the cartridge body in fluid communication with the ink supply source. The printhead includes a semiconductor substrate having a plurality of ink ejection devices disposed on the substrate. A plurality of driver transistors are disposed on the substrate for driving the plurality of ink ejection devices. A programmable memory matrix containing embedded programmable memory devices is operatively connected to the ink jet printer for collecting and storing information on the semiconductor substrate for operation of the ink jet printer. A nozzle plate is attached to the semiconductor substrate for ejecting ink therefrom upon activation of the ink ejection devices.

An advantage of the invention is that it provides printheads having increased on-board memory while reducing the area of the substrate required for memory device allocation. For example, printheads having conventional fuse or fuse diode memory devices require about four times the substrate surface area as an embedded memory device according to the invention. Accordingly, for the same substrate surface area, substantially more memory can be provided for a printhead using an embedded memory device according to the invention. Likewise, printhead substrates according to the invention containing the same amount of memory as substrates containing fuse memory devices, can be made substantially smaller.

For purposes of this invention, the term "embedded" is intended to mean integral with the substrate as opposed to being separate from but physically connected to the substrate by wires and/or electrical traces. An embedded memory device is a device that is formed in the silicon substrate that is used for providing the fluid ejection devices and drivers for a micro-fluid ejecting device such as an ink jet printhead.

BRIEF DESCRIPTION OF THE DRAWINGS

Further advantages of the invention will become apparent by reference to the detailed description of preferred embodiments when considered in conjunction with the following drawings illustrating one or more non-limiting aspects of the invention, wherein like reference characters designate like or similar elements throughout the several drawings as follows.

DETAILED DESCRIPTION OF THE INVENTION

Figure 1:
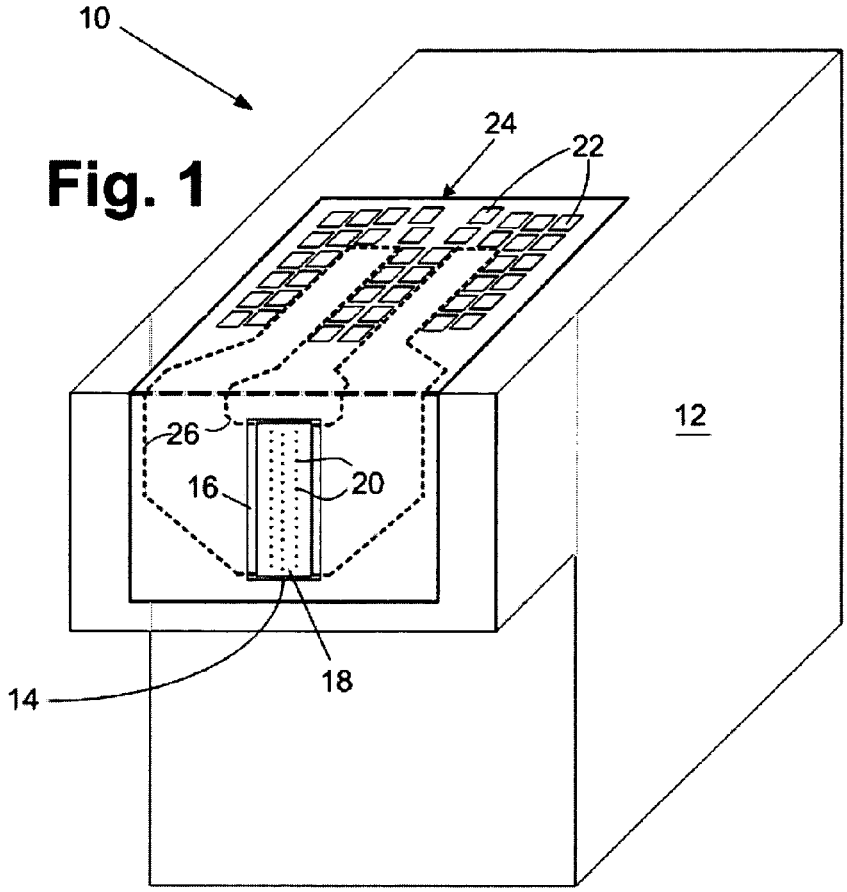
FIG. 1 is a micro-fluid ejecting device cartridge, not to scale, containing a semiconductor substrate according to the invention.

With reference to FIG. 1, a fluid cartridge 10 for a micro-fluid ejecting device is illustrated. The cartridge 10 includes a cartridge body 12 for supplying a fluid to a fluid ejection head 14. The fluid may be contained in a storage area in the cartridge body 12 or may be supplied from a remote source to the cartridge body.

The fluid ejection head 14 includes a semiconductor substrate 16 and a nozzle plate 18 containing nozzle holes 20. It is preferred that the cartridge be removably attached to a micro-fluid ejecting device such as an ink jet printer. Accordingly, electrical contacts 22 are provided on a flexible circuit 24 for electrical connection to the micro-fluid ejecting device. The flexible circuit 24 includes electrical traces 26 that are connected to the substrate 16 of the fluid ejection head.

Figure 2:
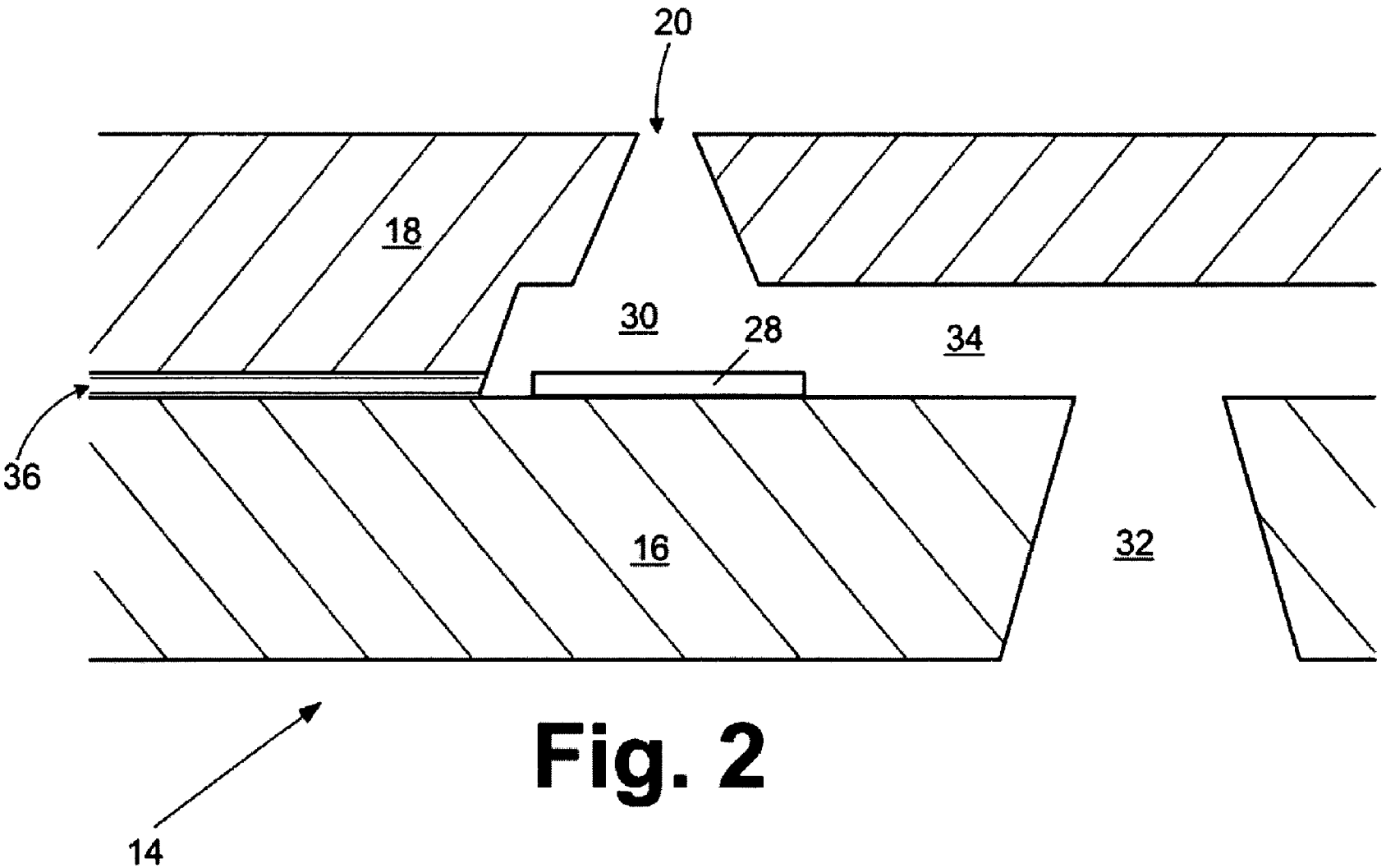
FIG. 2 is a cross-sectional view, not to scale of a portion of a micro-fluid ejection head according to the invention.

An enlarged view, not to scale, of a portion of the fluid ejection head 14 is illustrated in FIG. 2. In this case, the fluid ejection head 14 contains a thermal heating element 28 for heating the fluid in a fluid chamber 30 formed in the nozzle plate 18 between the substrate 16 and a nozzle hole 20. However, the invention is not limited to a fluid ejection head 14 containing a thermal heating element 28. Other fluid ejection devices, such as piezoelectric devices may also be used to provide a fluid ejection head according to the invention.

Fluid is provided to the fluid chamber 30 through an opening or slot 32 in the substrate 16 and through a fluid channel 34 connecting the slot 32 with the fluid chamber 30. The nozzle plate 18 is preferably adhesively attached to the substrate 16 as by adhesive layer 36. In a particularly preferred embodiment, the micro-fluid ejecting device is a thermal or piezoelectric ink jet printhead. However, the invention is not intended to be limited to ink jet printheads as other fluids may be ejected with a micro-fluid ejecting device according to the invention.

Figure 3:
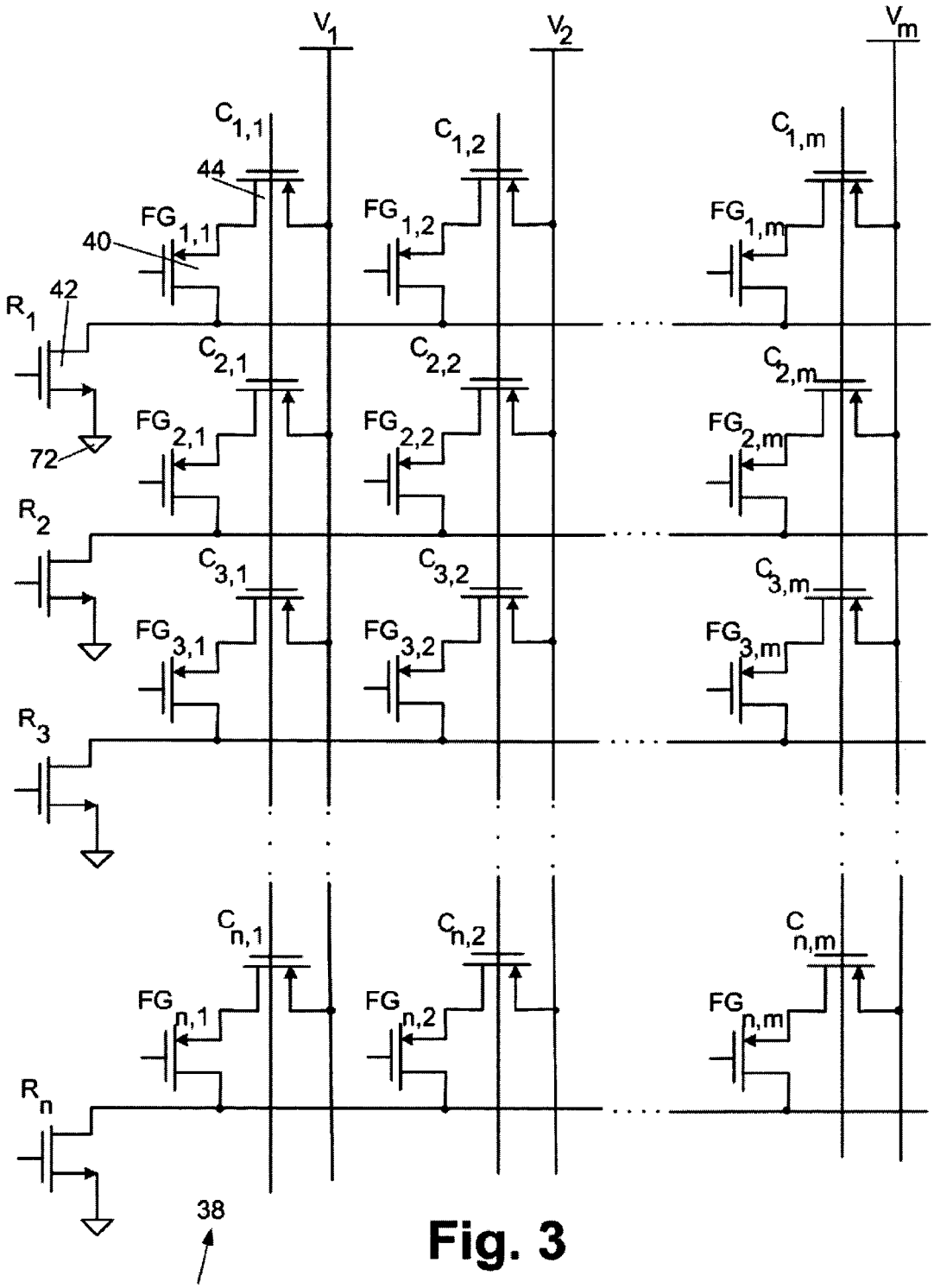
FIG. 3 is a schematic drawing of an embedded memory matrix according to the invention.
Figure 4:
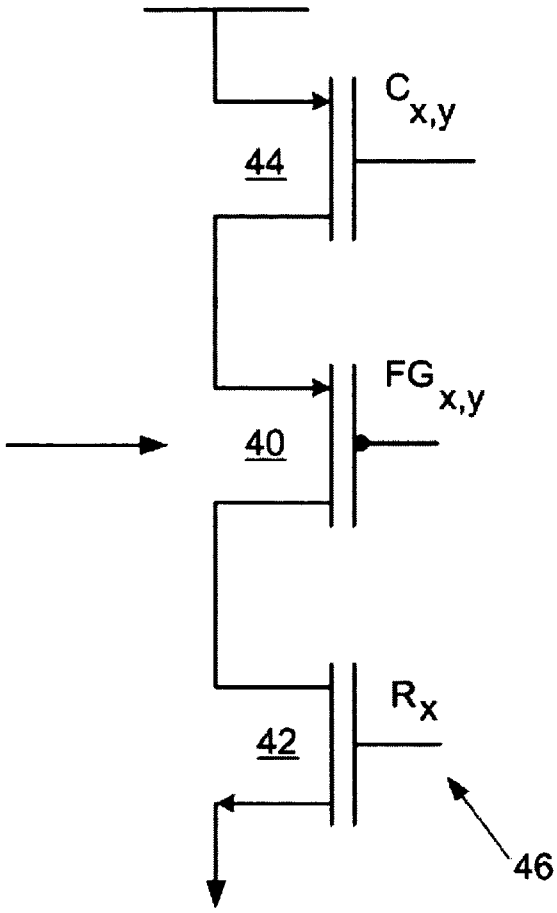
FIGS. 4 and 5 are schematic drawings of embedded memory cells according to the invention.
Figure 5:
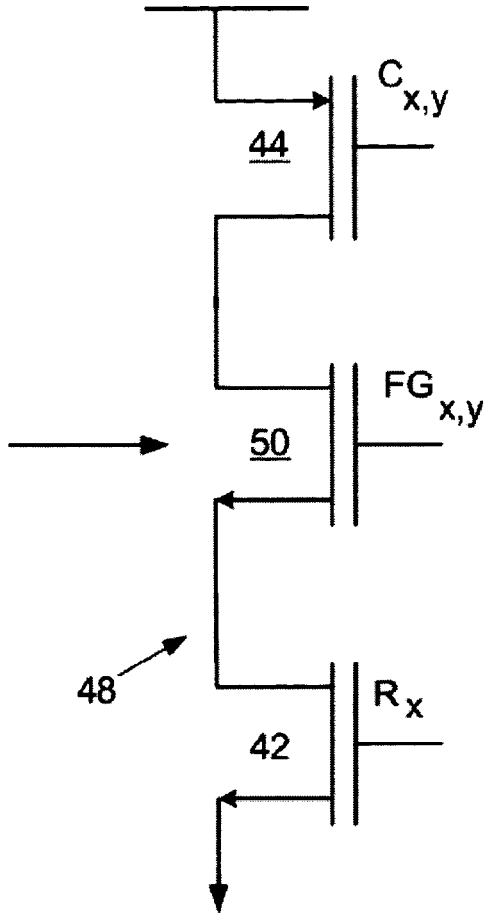

In one embodiment of the invention, the semiconductor substrate 16 includes a programmable memory array 38 embedded in the substrate 16. A portion of a 32-bit programmable memory array 38 is illustrated schematically in FIG. 3. As shown in FIG. 3, the programmable memory array 38 includes a plurality of PMOS or NMOS floating gate transistors 40, coupled between row 42 and column 44 pass transistors. The combination of floating gate transistor 40 and pass transistors 42 and 44 define a memory cell. Memory cells may include either PMOS floating gate transistors 40 or NMOS floating gate transistors 50 (FIG. 5). In the embodiment shown in FIG. 4, column pass transistor 44 is a PMOS transistor and row pass transistor 42 is an NMOS transistor. An NMOS floating gate memory cell 48 as shown in FIG. 5 may be provided by using an NMOS floating gate transistor 50 instead of a PMOS floating gate transistor 40 coupled to the pass transistors 44 and 42.

Figure 6:
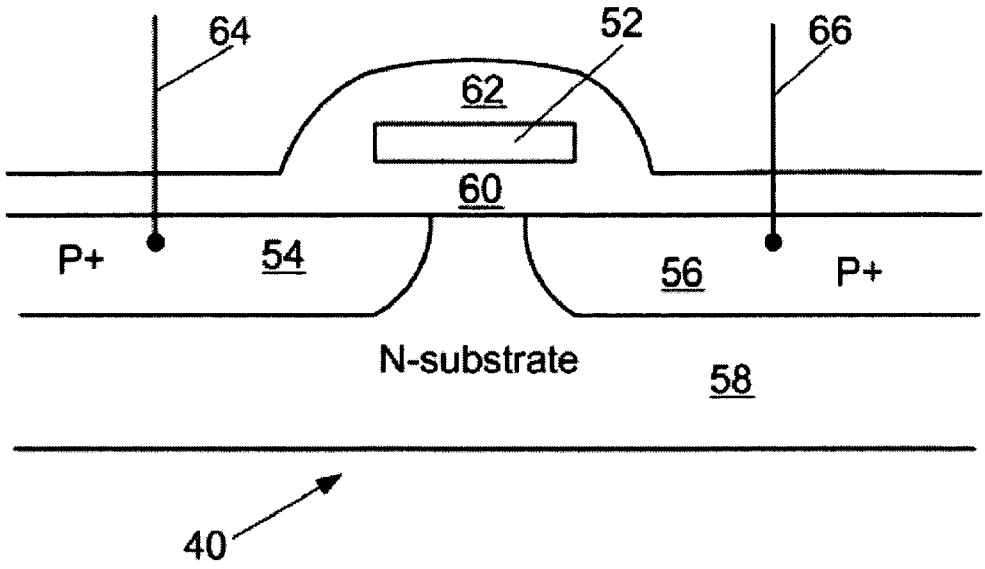
FIGS. 6 and 7 are schematic drawings of PMOS floating gate memory devices according to the invention.
Figure 7:
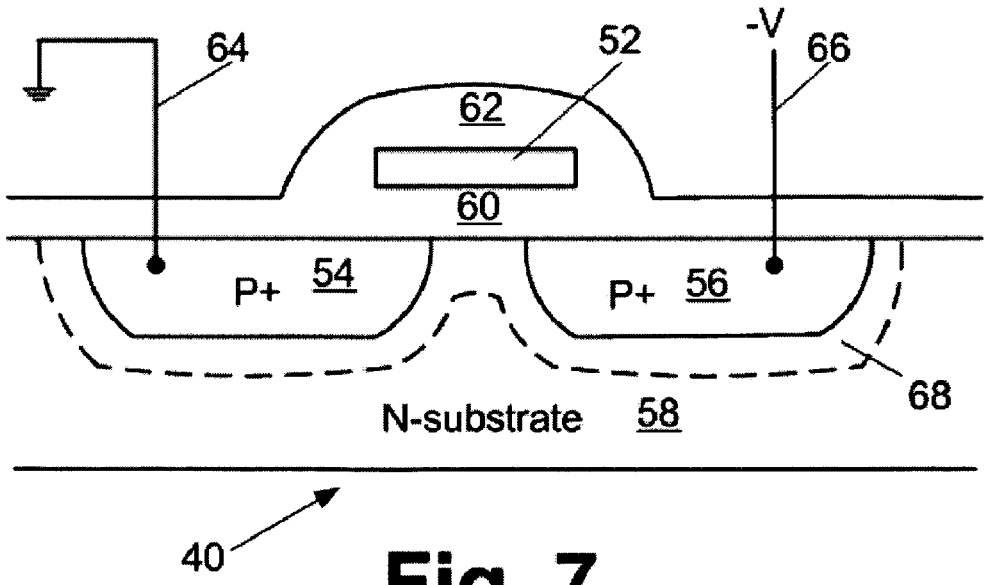

In a particularly preferred embodiment, the floating gate transistor 40 is a PMOS transistor 40 shown schematically in cross-section in FIGS. 6 and 7. Each of the floating gate transistors 40 contains an electrically isolated polysilicon floating gate 52 capable of storing charge (electrons). The amount of electrons stored on the floating gate 52 modifies the behavior of the floating gate transistor 40.

The floating gate transistor 40 includes a pair of spaced apart regions 54 and 56 (source and drain) which are opposite in conductivity type to the conductivity type of a substrate 58. The regions which define a pair of PN junctions, one between each region 54 and 56 and the substrate 58 may be produced on the substrate 58 using commonly known semiconductor techniques. The floating gate 52 of the transistor 40 is spatially disposed between the regions 54 and 56 and is preferably completely enclosed within insulative layers 60 and 62, so that no electrical path exists between the gate 52 and any other parts of the transistor 40. Metal contacts represented by lines 64 and 66 are used to provide electrical contacts to the source and drain regions 54 and 56, respectively. The transistor 40 may be produced in the semiconductor substrate 58 using known MOS or silicon gate technology.

As shown in FIG. 6, the substrate 58 comprises an N-type silicon substrate 58, the source and drain regions 54 and 56 comprise P-type regions, the contacts 64 and 66 comprise aluminum or other conducting metal, and the gate 52 comprises silicon or polysilicon. The insulative layers 60 and layer 62 comprise a silicon oxide such as SiO or $SiO_2$. The N-type region may be an NWELL region in a P-type substrate.

Insulative layer 60 which separates the gate 52 from the substrate 58 may be relatively thick; for example, it may be about 100 Angstroms to about 1,000 Angstroms thick. This thickness may be readily achieved using present MOS technology. Insulative layer 62 is preferably about 8,000 Angstroms thick and is preferably comprised of a thermally grown silicon oxide directly above the gate 52 and chemical vapor deposited doped silicon glass above the thermal oxide.

The gate 52 of the transistor 40 may be charged without the use of a charging gate or electrode attached to the gate 52. The charge is placed on the gate 52 through use of the metal contacts 64 and 66 and the substrate 58. A charge is transferred to the gate 52 through the insulative layer 60 by a combination of capacitive coupling between the source 54 and the gate 52, drain-induced barrier lowering (DIBL), and punchthrough. For example, the source region 54 may be coupled to ground via the contact 64 and region 56 may be coupled to a negative voltage via contact 66 while the substrate 58 is also grounded. To charge the gate 52, a negative voltage is applied to contact 66 of sufficient magnitude to cause current flow from drain 56 to source 54. Impact ionization in the drain's high filed region will generate hot electrons. The electrons are injected into the gate oxide 60 and accumulated in the floating gate 52. For a single bit per cell device, the transistor 40 either has little charge (<5,000 electrons) on the floating gate 52 and thus stores a "1" or it has a lot of charge (>30,000 electrons) on the floating gate 52 and thus stores a "0."

Once the gate 52 is charged, it will remain charged for a substantially long period of time since no discharge path is available for the accumulated electrons within gate 52. After the voltage has been removed from the transistor 40, the only other electric field in the structure is due to the accumulated electron charge within the gate 52. The charge on the gate 52 is not sufficient to cause charge to be transported across the insulative layer 60. It will be appreciated that the gate 52 could have been charged in the same manner as described above with the substrate 58 and/or contact 64 biased at some potential other than a ground potential.

The existence or non-existence of a charge on gate 52 may be determined by examining the characteristics of the transistor 40 at the contacts 64 and 66. This may be done, for example, by applying a voltage between contacts 64 and 66. This voltage should be less than the voltage required to cause an accumulation of charge on the gate. The transistor 40 more readily conducts a current if a charge exists on gate 52 as compared to the current conducted by the same transistor without a charge on its gate 52, thereby acting as a depletion mode transistor. While the foregoing floating gate transistor 40 has been described as a PMOS type transistor, the same structure can be provided by a P-type substrate with N-type regions for the source and drain, i.e., and NMOS transistor. An NMOS transistor is charged positively by hot-hole injection using the same programming method as used for the PMOS device.

Figure 8:
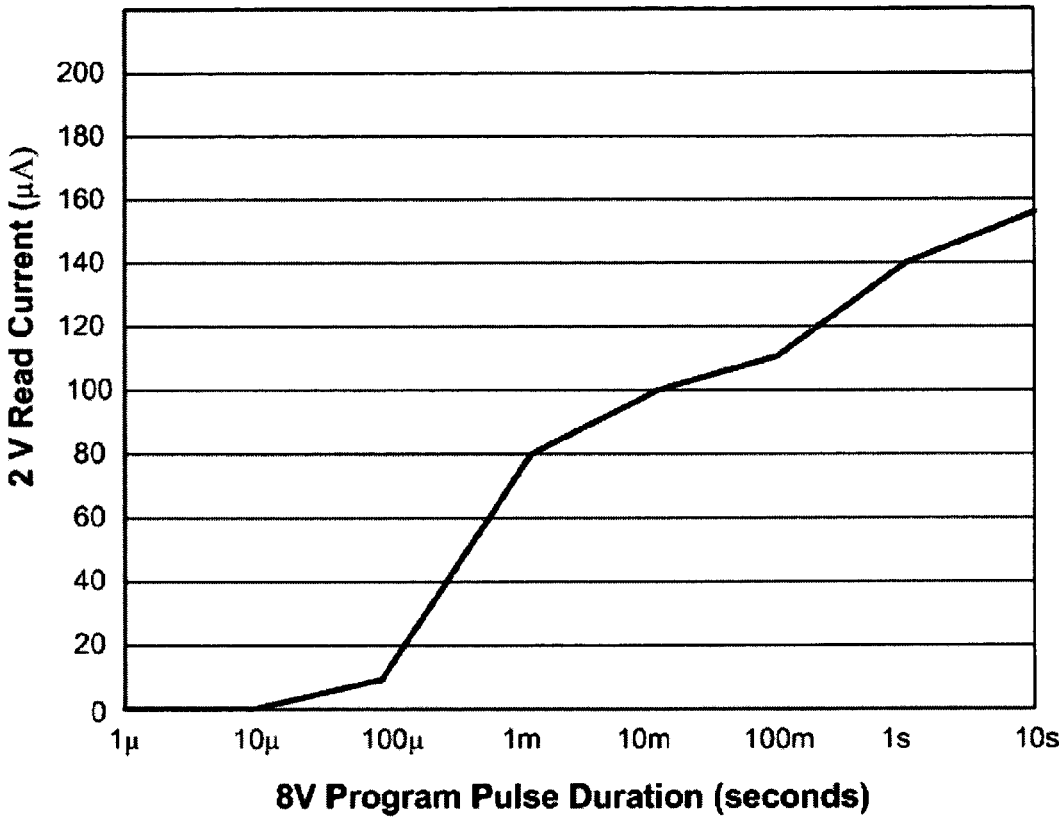
FIG. 8 is a graph of read current versus pulse duration for an embedded memory device according to the invention.

In a preferred embodiment, the programming voltage required for programming the floating gate transistor 40 is greater than about 8 volts for about 100 microseconds or longer. Reading voltages are preferably less than about 3 volts. Accordingly, programmed floating gate transistors 40 according to the invention will preferably pass from about 10 to about 200 microamps of current at a reading voltage of about 2 volts. Unprogrammed floating gate transistors 40 will preferably pass less than about 100 nanoamps of current at a reading voltage of about 2 volts. A graph of the current for a reading voltage of 2 volts versus the pulse duration time for programming the floating gate transistor 40 at about 8 volts is illustrated in FIG. 8.

The charge on the gate 52 may be removed by a number of methods, including but not limited to X-ray radiation and ultraviolet (UV) light. For example, if the transistor 40 is subjected to X-ray radiation of $2\times10^5$ rads through the insulative layer 62, the charge on the gate 52 will be removed. Likewise, exposing the gate 52 through the insulative layer 62 to UV light of the order of magnitude below 400 nanometers will cause the charge to be removed from the gate 52. Also, subjecting the transistor 40 to a temperature of greater than about 100° C. will accelerate charge loss from the gate 52.

In order to protect floating gate transistors 40 or 50 in the programmable memory matrix 38 from inadvertent deprogramming, it is preferred that at least the area of the semiconductor substrate 16 containing the programmable memory matrix 38 contain a layer opposite the substrate that is sufficient to block UV light. This layer may be selected from a variety of materials, including but not limited to metals, photoresist materials, and polyimide materials. In a preferred embodiment, the nozzle plate 18 (FIG. 2) is preferably made of a UV light opaque polyimide material and the nozzle plate 18 covers the area of the substrate 16 containing the programmable memory matrix 38. Likewise, a metal, such as a copper or gold conductor, may also be provided over the programmable memory matrix 38 to block UV light.

Figure 9:
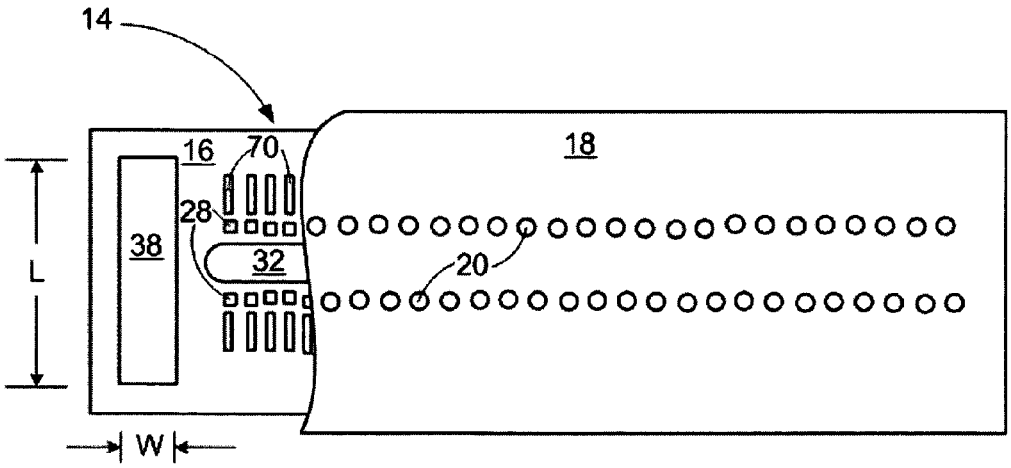
FIG. 9 is a plan view, not to scale, of a micro-fluid ejection head containing a memory matrix according to the invention.

A plan view of the layout of a semiconductor substrate 16 containing a programmable memory matrix 38, heater resistors 28 and heater drivers 70 is shown in FIG. 9. The programmable memory matrix 38 is embedded in the substrate 16 containing fluid ejection devices 28 and drivers 70. In the device 14 shown in FIG. 9, a single slot 32 is provided in the substrate 16 to provide fluid such as ink to the ink ejection devices 28 that are disposed on both sides of the slot. However, the invention is not limited to a substrate having a single slot 32 or to fluid ejection devices 28 disposed on both sides of the slot. The nozzle plate 18, preferably made of a UV light opaque material such as polyimide is attached to the substrate 16 and preferably covers the area of the substrate containing the programmable memory matrix 38 so as to prevent deprogramming of the memory matrix 38 during use.

The area of the substrate 16 required for containing the progammable memory matrix 38 preferably has a width dimension W ranging from about 100 microns to about 5000 microns and a length dimension D ranging from about 100 microns to about 5000 microns. Accordingly, the memory density on the semiconductor substrate 16 is preferably greater than about 200 bits per square millimeter. Such a memory density is effective to provide a variety of data storage and data transfer functions to the micro-fluid ejection head 4. For example, the memory matrix 38 may be used to provide micro-fluid device head 14 identification, alignment characteristics of the head 14, fluid properties of the head 14 such as color, and/or the memory matrix 38 may be incremented to provide fluid levels or fluid use data. The data storage functions of the memory matrix 38 are virtually unlimited.

With reference again to FIG. 3, a method for reading and/or writing to the memory matrix will now be described. Initially, each of the floating gate transistors 40 in the matrix are unprogrammed. To program floating gate transistor $FG_{1,1}$ in column 1 and row 1 of the matrix, a voltage of at least about 10 volts is applied to column transistor $C_{1,1}$ through voltage input $V_1$ for a period of time sufficient to apply a charge to the floating gate of transistor $FG_{1,1}$. In this case, $FG_{1,1}$ is charged thereby providing a current path to pass transistor $R_1$ in row 1 of the matrix 38. The pass transistor $R_1$ is connected to a sense amp 72 for sensing the current. If a current of from about 10 to about 200 microamps is sensed by the sense amp, when a voltage of about 2 volts is applied to voltage input $V_1$, floating gate transistor $FG_{1,1}$ is in a programmed state. In this case, the presence or absence of current sensed by the sense amp 72 provides a digital signal of 0 to the micro-fluid ejecting device. By contrast, if the current sensed by sense amp 72 is less than about 100 nanoamps, the floating gate transistor $FG_{1,1}$ is in an unprogrammed state. The absence of current sensed by the sense amp 72 provides a digital signal of 1 to the micro-fluid ejecting device.

The column pass transistors $C_{1,1}$ to $C_{n,m}$ and row pass transistors $R_1$ to $R_n$, where m is the number of columns and n is the number of rows can be used to select which of the floating gate transistors $FG_{1,1}$ to $FG_{n,m}$ are programmed by 10 volts applied to $V_1$ to $V_m$. The same process can be used to program the other floating gate transistors 40 in the matrix by applying voltage to $V_2$ through $V_m$ and selecting the appropriate row and column pass transistors. In a particularly preferred embodiment, the memory matrix contains at least 128 columns and 32 rows containing the memory cells 46 described above.

Figure 10:
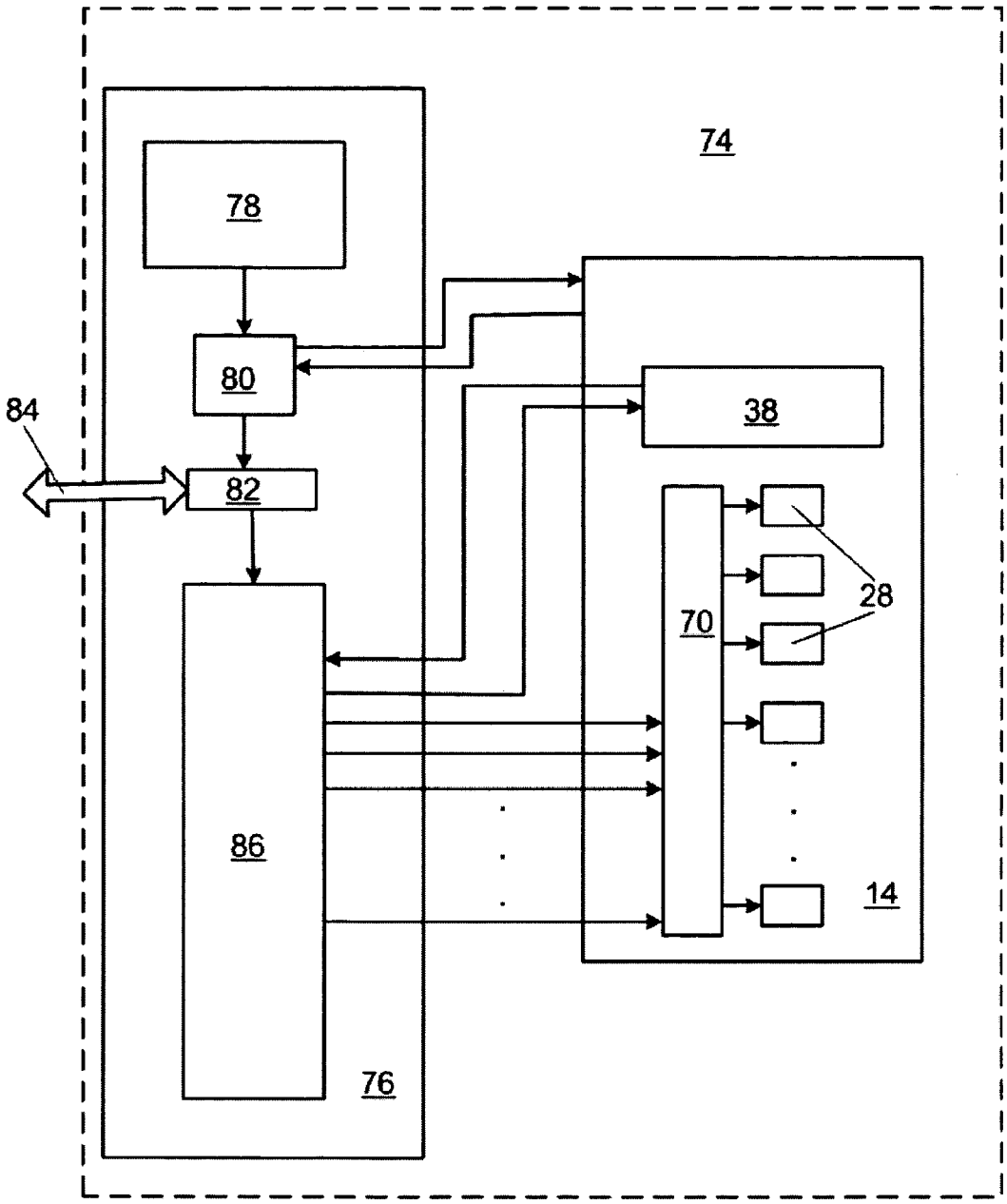
FIG. 10 is a partial simplified logic diagram of a micro-fluid ejection device containing an ejection head according to the invention.
Figure 11:
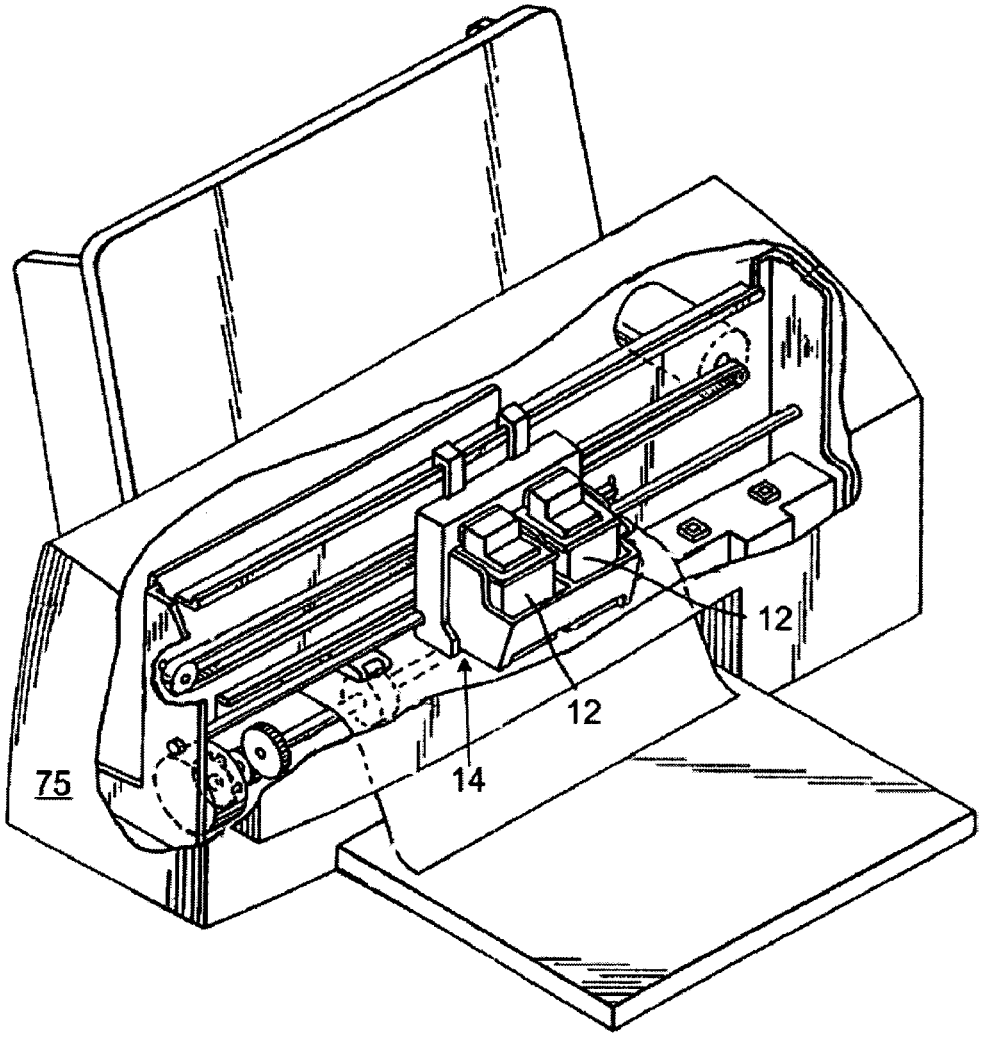
FIG. 11 is a perspective view of a micro-fluid ejecting device according to the invention.

FIG. 10 is a partial logic diagram for a micro fluid ejection device 74 such as a printer 75 (FIG. 11) according to the invention. The device 74 includes a main control system 76 connected to the micro fluid ejection head 14. As described above with reference to FIG. 9, the head 14 includes device drivers 70 and fluid ejection devices 28 connected to the device drivers 70. The programmable memory matrix 38 is also located on the ejection head 14. The ejection device 74 includes a power supply 78 and an AC to DC converter 80. The AC to DC converter 80 provides power to the ejection head 14 and to an analog to digital converter 82. The analog to digital converter 82 accepts a signal 84 from an external source such as a computer and provides the signal to a controller 86 in the device 74. The controller 86 contains logic devices, for controlling the function of the drivers 70. The controller 86 also contains local memory and logic circuits for programming and reading the memory matrix 38. Accordingly, the operation of the device 74 can be tailored to the inputs received from the memory matrix 38 thereby improving the operation of a device 74 such as an ink jet printer.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A substrate for a micro-fluid ejecting device, the substrate comprising:

a plurality of fluid ejection devices;

a plurality of driver devices for driving the plurality of fluid ejection devices;

a nonvolatile programmable memory matrix containing embedded programmable memory devices, the matrix capable of being operatively connected to the micro-fluid ejecting device for storing information for operation of the micro-fluid ejecting device, wherein the memory matrix is erasable by ultraviolet light; and a layer disposed adjacent the nonvolatile programmable memory matrix, said layer having properties sufficient to block ultraviolet light having a wavelength below about 400 nanometers.

2. The substrate of claim 1 wherein the embedded programmable memory devices comprise transistors selected from the group consisting of PMOS and NMOS floating gate transistors.

3. The substrate of claim 1 wherein the embedded programmable memory devices have a memory density of greater than about 200 bits per square millimeter.

4. The substrate of claim 1 wherein the programmable memory matrix comprises floating gate transistors.

5. The substrate of claim 1 wherein the programmable memory matrix comprises more than 128 memory devices.

6. The substrate of claim 1 wherein the embedded programmable memory devices are programmable by applying a voltage of greater than about 8 volts for at least about 100 microseconds.

7. The substrate of claim 1 wherein the embedded programmable memory devices will pass from about 10 to about 200 microamps of current at about 2 volts in a programmed state.

8. The substrate of claim 1 wherein the embedded programmable memory devices will pass less than 3 microamps of current at about 2 volts in an unprogrammed state.

9. A printhead for an ink jet printer containing the substrate of claim 1.

10. The printhead of claim 9 wherein the layer comprises a material selected from the group consisting of a photoresist material and a metal.

11. The printhead of claim 9 wherein the layer comprises a polyimide nozzle plate.

12. An ink jet printer cartridge for an ink jet printer comprising:

a cartridge body having an ink supply source; and a printhead attached to the cartridge body in fluid communication with the ink supply source, the printhead comprising:

a substrate having a plurality of ink ejection devices;

a plurality of driver devices for driving the plurality of ink ejection devices;

a nonvolatile programmable memory matrix containing embedded programmable memory devices, the matrix being operatively connected to the ink jet printer for storing information for operation of the printer wherein the memory matrix is erasable by ultraviolet light;

a photoresist layer disposed adjacent the programmable memory matrix, said photoresist layer having properties sufficient to block ultraviolet light having a wavelength below about 400 nanometers; and a nozzle plate attached to the substrate for ejecting ink therefrom upon activation of the ink ejection devices.

13. The ink jet printer cartridge of claim 12 wherein the embedded programmable memory devices comprise transistors selected from the group consisting of PMOS and NMOS floating gate transistors.

14. The ink jet printer cartridge of claim 12 wherein the embedded programmable memory devices have a memory density of greater than about 200 bits per square millimeter.

15. The ink jet printer cartridge of claim 12 wherein the programmable memory matrix comprises floating gate transistors.

16. The ink jet printer cartridge of claim 12 wherein the programmable memory matrix comprises more than 128 memory devices.

17. The ink jet printer cartridge of claim 12 wherein the embedded programmable memory devices are programmable by applying a voltage of greater than about 8 volts for at least about 100 microseconds.

18. The ink jet printer cartridge of claim 12 wherein the embedded programmable memory devices will pass from about 10 to about 200 microamps of current at about 2 volts in a programmed state.

19. The ink jet printer cartridge of claim 12 wherein the embedded programmable memory devices will pass less than 3 microamps of current at about 2 volts in an unprogrammed state.

20. The ink jet printer cartridge of claim 12 wherein the nozzle plate comprises a polyimide nozzle plate having properties sufficient to block ultraviolet light having a wavelength below about 400 nanometers.

* * * * *